US006546687B2

(12) United States Patent
Oh et al.

(10) Patent No.: US 6,546,687 B2
(45) Date of Patent: Apr. 15, 2003

(54) WATERPROOFING METHOD BY USING PLASTIC PANELS

(75) Inventors: Sang Keun Oh, #306-804 Geonyoung Apt., Junggye 1-dong, Nowon-gu, Seoul (KR), 139-790; Sung Min Choi, Seoul (KR); Ki Sun Bae, Seoul (KR)

(73) Assignee: Sang Keun Oh, Seoul (KR)

( * ) Notice: Subject to any disclaimer, the term of this patent is extended or adjusted under 35 U.S.C. 154(b) by 0 days.

(21) Appl. No.: 09/839,612

(22) Filed: Apr. 20, 2001

(65) Prior Publication Data

US 2001/0039781 A1 Nov. 15, 2001

(30) Foreign Application Priority Data

Apr. 20, 2000 (KR) ..... 2000-20953

(51) Int. Cl.[7] ..... E04D 1/24

(52) U.S. Cl. ..... 52/409; 52/411; 52/309.4; 52/309.3; 52/533; 52/535; 52/536; 52/560; 52/553; 52/591.1; 52/746.11; 52/747.11; 52/748.11

(58) Field of Search ..... 52/403, 409, 411, 52/415, 309.8, 533, 536, 542, 560, 572.4, 541, 547, 746.1, 747.11, 748.11, 748.1, 535, 592.2, 591.1, 553, 309.4

(56) References Cited

U.S. PATENT DOCUMENTS 2,392,551 A * 1/1946 Roe ..... 52/592.4
2,749,739 A * 6/1956 Zagray ..... 52/592.4
3,411,256 A * 11/1968 Best
4,016,323 A 4/1977 Volovsek
4,045,265 A 8/1977 Tajima et al.
4,386,981 A 6/1983 Clapperton
4,432,183 A * 2/1984 Pike et al. ..... 52/533
4,651,494 A * 3/1987 Van Wagoner ..... 52/593
4,899,514 A * 2/1990 Brookhart, Jr. ..... 52/553
4,914,885 A * 4/1990 Baker et al. ..... 52/520
5,214,895 A * 6/1993 Fifield ..... 52/533
5,452,553 A 9/1995 Clapp et al.
5,519,975 A * 5/1996 Taylor et al. ..... 52/533

* cited by examiner

*Primary Examiner*—Carl D. Friedman
*Assistant Examiner*—Yvonne M. Horton
(74) *Attorney, Agent, or Firm*—Madson & Metcalf

(57) ABSTRACT

An improved waterproofing system for the concrete slab of a flat roof on a building is disclosed. The waterproofing system uses hollow plastic panels of designed size, different thickness, and groove and tongue joints for interconnecting the panels. A supplementary waterproofing layer may be installed using sheet membrane materials such as asphalt sheet, metal sheet and other sheets on vertical surfaces, especially the parapet of the roof. The invention further concerns a construction method for applying a fiber mesh reinforcement on the connection joint and for applying fluid-applied materials on the substrate with sheet membrane layers on vertical surfaces. The waterproofing layer of sloped step type, hollow plastic panels of different thickness, permits fast drainage of stagnant water, which inhibits weather damage to the waterproofing layer.

10 Claims, 6 Drawing Sheets

WATERPROOFING METHOD BY USING PLASTIC PANELS

BACKGROUND OF THE INVENTION

The invention provides an improved waterproofing system for the concrete slab of a flat roof on a building. More specifically, the invention relates to a construction method for installing a waterproofing layer by using a plastic panel of designed size on the concrete substrate, and installing a supplementary waterproofing layer by using a general sheet membrane material such as asphalt sheet, metal sheet and other sheets on a vertical surface, especially parapet, and further relates to a multi-ply construction method for installing fluid-applied materials and reinforcing fiber meshes on the surface to connect the plastic panel layer on substrate with the sheet membrane layer on the vertical surface.

In the conventional waterproofing systems for the concrete substrate, especially roofs on buildings, a single-ply waterproofing system by using fluid-applied materials such as urethane or polymeric asphalt and cementitious materials, or sheet membrane materials such as thermoplastics, rubberized asphalt, vulcanized rubberized and stainless steel is well known.

However, the single-ply waterproofing system by using fluid-applied materials is apt to be affected by the surface condition of the substrate, weather, and condition of the roof that may create blisters, debondment, tears, cracks, etc. It is also difficult to prevent water leakage at the overlapped joint of a sheet membrane. Thus, labor expenses and time increase to prepare the substrate and to repair defects of the waterproofing layer.

In order to solve the problems of single-ply waterproofing systems that use fluid-applied materials or sheet membrane, a proposal has been made to install a multi-ply or double-ply membrane which uses both fluid-applied materials and sheet membranes as a multi-ply waterproofing system of urethane and modified asphalt sheet, or a multi-ply waterproofing system of cementitious materials and stainless steel plate.

Although the proposed waterproofing system has solved some problems of the single-ply waterproofing system, other problems still remain unsolved as follows:

First, in case of the multi-ply waterproofing system of urethane and modified asphalt sheet, because both materials are flexible, it is difficult to make a sloped waterproofing layer adaptable for fast water drainage. Accordingly, there are many places where rain or melted snow stagnates on the waterproofing layer, which ultimately causes the waterproofing layer to become aged, faded, cracked and blistered. Because of the flexible property, this system does not withstand the pressure occurring from foot traffic and movement of objects for utility of a roof space.

Second, multi-ply waterproofing systems that use cementitious materials and stainless steel plate have shortcomings such as debondment of the waterproofing layer between the materials and noise occurring when a workman walks on the waterproofing layer. Metal sheet is deformed by thermal expansion and contraction, and the overlapped joint may burst open. Thus, it is hard for a worker to carry and treat the metal sheet. For this reason, construction delays occur and labor and construction costs are increased.

Third, since each material of the multi-ply waterproofing system has a different surface condition and adhesion mechanism, the system cannot gain a good adhesion to adjacent materials after application. The problems of blistering, cracking and tearing caused by weather affect the overlapped part of sheet membranes during many application steps of the multi-ply waterproofing system.

Finally, because installation of the multi-ply waterproofing system is mainly made at the job site, weather may affect many installation steps such as carrying, mixing, application, curing and setting of a ventilation plate, and overlapping and sealing of seams in every material such as fluid-applied materials or sheets. There is a need in the art for a waterproofing method that overcomes these problems with known waterproofing systems.

SUMMARY OF THE INVENTION

The present invention provides a multi-ply waterproofing system in which the waterproofing layer uses a hollow plastic panel of designed size, holes and thickness on a concrete slab of a flat roof on a building. The waterproofing system includes a supplementary waterproofing layer that uses general membrane materials such as asphalt sheets, metal sheets and other membrane sheets on the vertical elements, especially the parapet, of the roof.

The single-ply system that uses fluid-applied materials for waterproofing a flat roof on buildings is apt to be affected by the surface condition of the substrate, weather and condition of the roof that may create blisters, debondment, tears, cracks, etc. In case of a single-ply system using sheet membrane, it is difficult to prevent water leakage at an overlapped joint of a sheet membrane. Thus, working hours and expenses increase to prepare the substrate and to repair defects of the waterproofing layer.

The invention provides an improved waterproofing system for the concrete slab of a flat roof on a building. More specifically, the invention relates to the construction method for installing the waterproofing layer by using a hollow plastic panel of designed size and thickness on a concrete substrate, and installing the supplementary waterproofing layer by using sheet membrane materials on the vertical surface, especially the parapet of the roof. The invention further relates to the construction method for installing reinforcing fiber meshes on the joint line that connects the plastic panels on the flat substrate with the sheet membrane layer on the vertical surface. A main property of the invention is to install the waterproofing layer of sloped-step type hollow plastic panels of a different thickness for fast drainage of stagnant water, which otherwise would cause physical damage in the performance of the waterproofing layer. Several important features of the invention are as follows:

1. The plastic panel has several hollow parts in the inside thereof which may be configured in a variety of cross-sectional shapes, such as a circle or square. The upper or lower face of the edge parts in the plastic panel preferably has groove and tongue joints for connecting the panels together. This joint permits the space protection of the panel layer against the thermal expansion and contraction. Other panel connection methods may also be utilized.
2. The plastic panel preferably has holes for fixing the panels on the substrate and for setting the special plates to ventilate the moisture existing in the space between the panels and the substrate.
3. The waterproofing layer on substrate is installed as a sloped step to easily drain the stagnant water on the waterproofing layer. The plastic panels may have a size of about 1 m×1 m (or about one square yard in size), and from 2–15 cm in thickness.
4. The lines of the panels connected by the groove and the tongue joint are reinforced with sheet tape made of high strength of fiber, such as carbon fiber, glass fiber, armada fiber, etc. for preventing water penetration and movement of panels. At this time, the reinforcing tapes are preferably adhesive tapes.

DETAILED DESCRIPTION OF THE INVENTION

The waterproofing layer in accordance with the present invention comprises a main waterproofing layer using a molded plastic panel of designed size on concrete substrate of a flat roof slab and a supplementary waterproofing layer by using the general membrane materials such as asphalt or polymeric membrane sheets on the vertical elements, especially the parapet of roofs.

Figure 1:
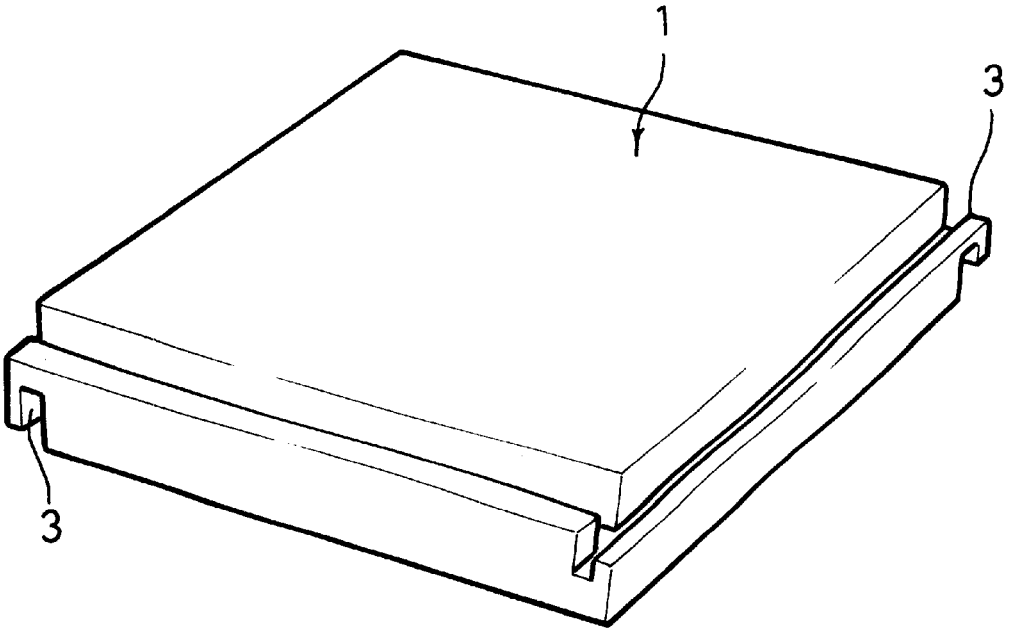
FIG. 1 is a prospective view of a plastic panel according to the invention.
Figure 2:
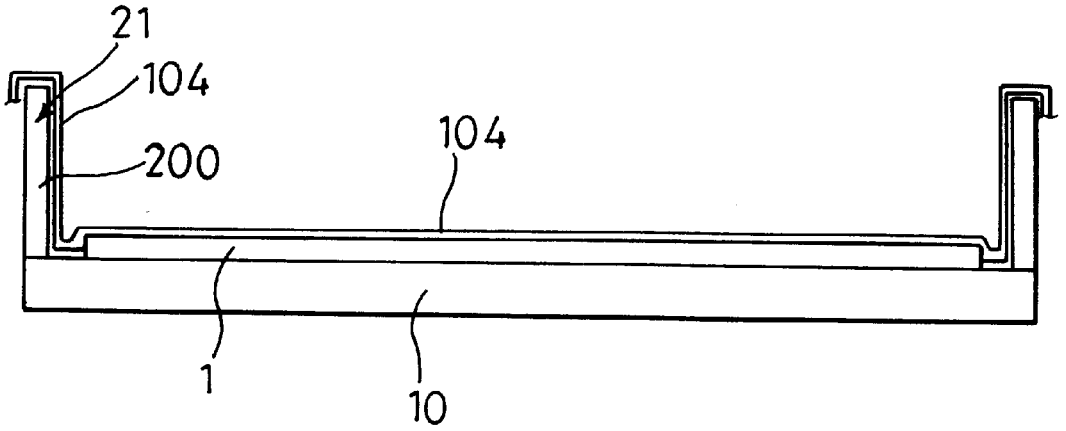
FIG. 2 is a sectional view showing installation of a waterproofing layer by using the plastic panel according to the invention.

The waterproofing method in accordance with the present invention defines a method for installing a waterproofing layer by using a plastic panel 1, as seen in FIG. 1, on concrete substrate 10 and a multi-ply waterproofing layer by using fluid-applied membrane 104 and sheet membrane 200 on vertical elements, especially the parapet 21 of a building roof, as seen in FIG. 2.

The main waterproofing layer 1 on the flat roof uses the plastic panel 1. The supplementary waterproofing on vertical elements, especially the parapet 21, uses a sheet membrane 200 overlaid by a fluid-applied membrane 104, as seen in FIG. 2. The fluid-applied membrane 104 functions as a protective layer of the plastic panel layer for watertightness and durability.

The plastic panel 1 as in FIG. 1 is factory-prepared. Important properties of the plastic panel 1 in the present invention are uniformity, homogeneity and quality.

The upper or lower face of edge parts in the plastic panel 1 has groove and tongue joints 3 for interconnecting each panel 1, as seen in FIGS. 1 and 4. The web of the groove and the tongue joint 3 may be characterized as rigid joint, or may have a space for distribution of stresses caused by movement of the plastic panels.

Figure 3A:
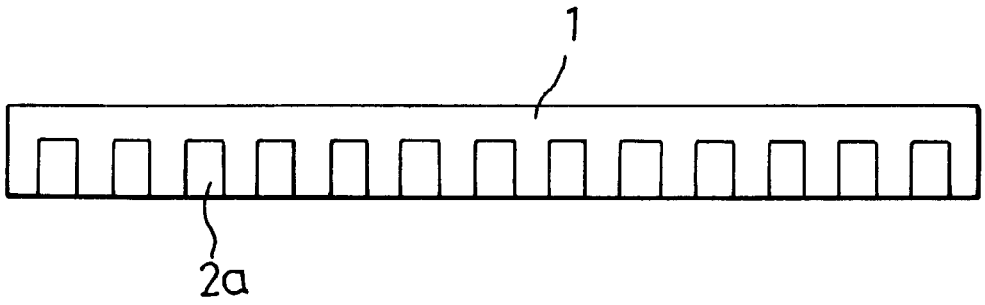
FIGS. 3*a* to 3*c* are sectional views of a plastic panel according to the invention.
Figure 3B:
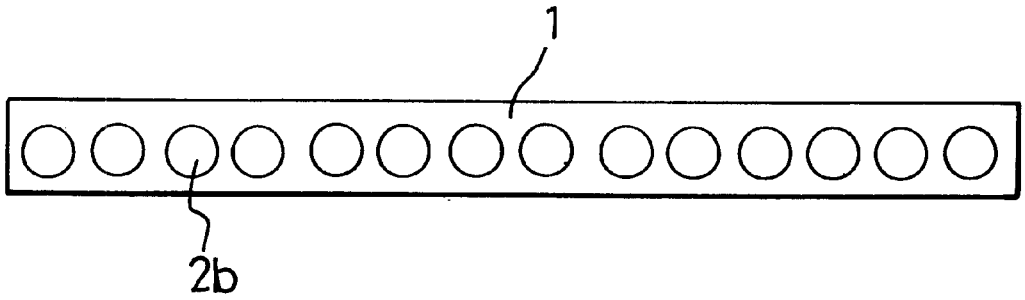
Figure 3C:
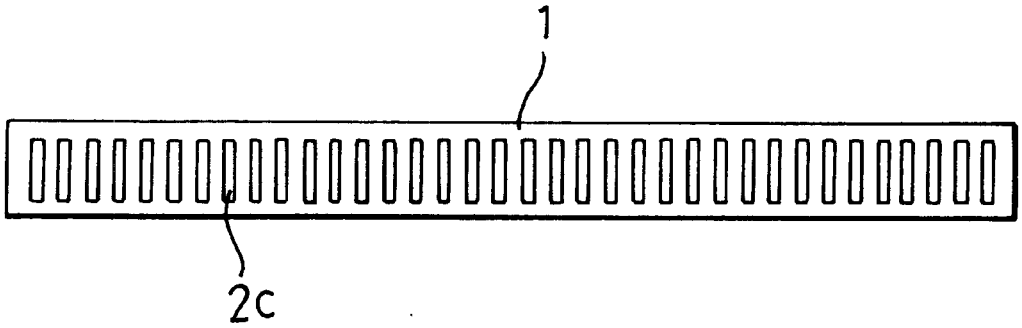

The plastic panel 1 has several hollow portions, which are preferably designed as a circle or square. The holes may be configured in a variety of other cross-sectional configurations including, but not limited to, a quadrangle 2*a,* circle 2*b* or rectangle 2*c,* as seen in FIG. 3.

The hollow plastic panel 1 is preferably manufactured of waterproof material, as seen in FIG. 1. The plastic panel 1 as a waterproofing layer on a flat slab in buildings can be made in different thicknesses ranging from 2 to 15 cm. The plastic panel 1 is made of high strength plastic or polymeric material that contains a hollow portion 2*a,* 2*b* and 2*c,* as seen in FIG. 3. Some preferred purposes of the hollow portion in the plastic panel 1 are to improve insulation performance, to make the panel lightweight and rigid, to reduce its deformation by thermal effects, and to reduce noise transfer by walking.

Figure 7:
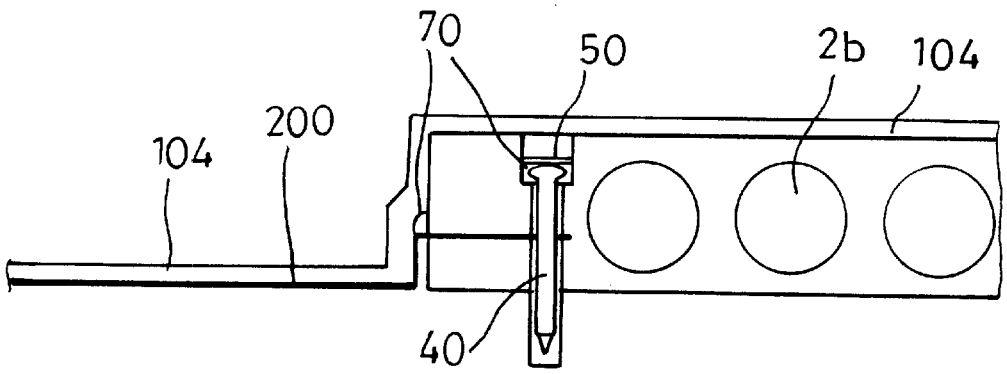
FIG. 7 is a sectional view of the connecting part of the plastic panels and the sheet membrane.
Figure 8:
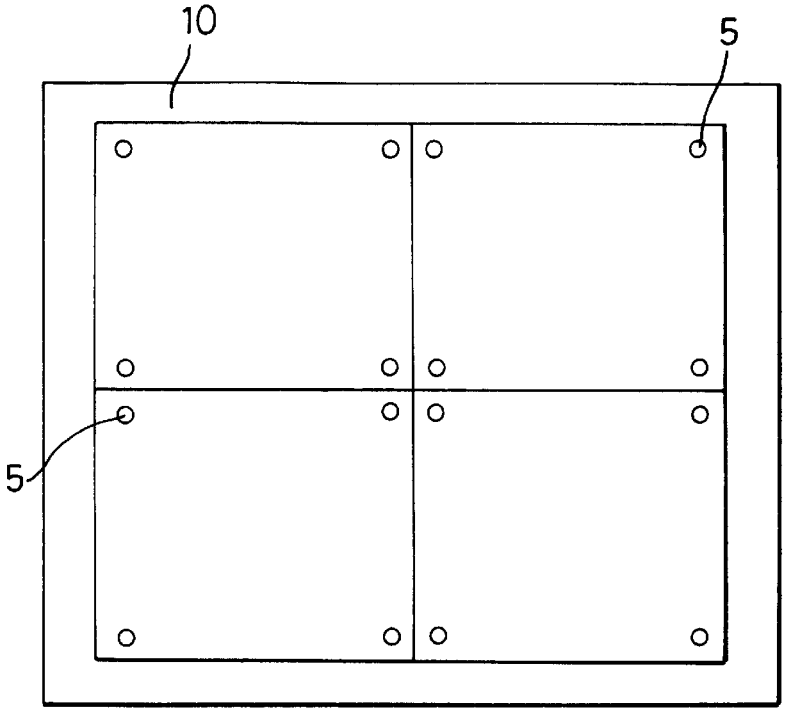
FIG. 8 is a top plan view showing a method for fixing the plastic panels according to the invention.

Furthermore, the hollow plastic panels 1 have holes 5 in the corners of the panel, as seen in FIG. 4, FIG. 7 and FIG. 8, for installation on the substrate. These holes 5 are filled with a sealant 70 and a protection cap 50 after installation of the plastic panel with nail 40 on concrete substrate, as seen in FIG. 7.

Figure 4A:
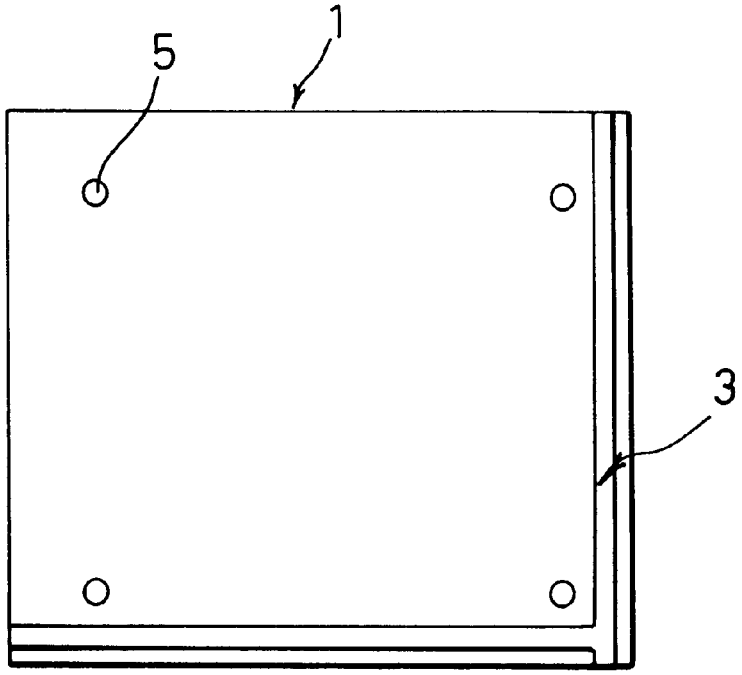
FIG. 4*a* is a top plan view of a plastic panel according to the invention.
Figure 4B:
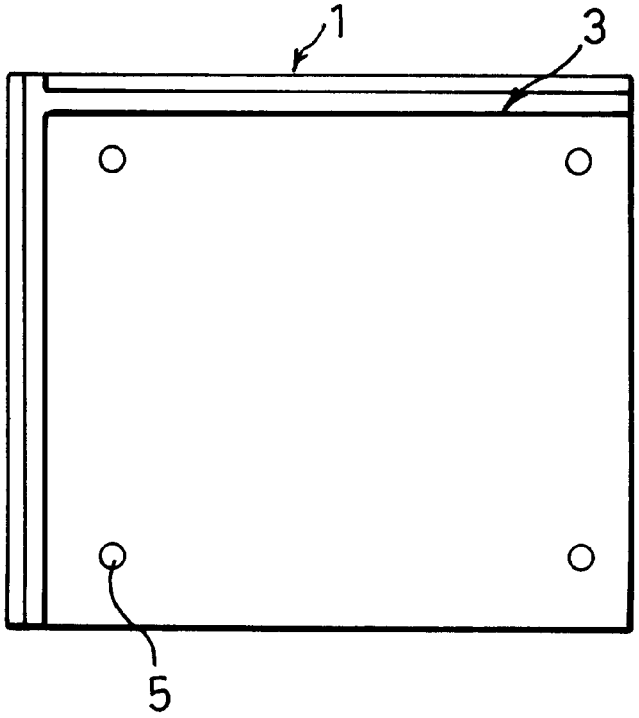
FIG. 4*b* is a bottom plan view of a plastic panel according to the invention.
Figure 4C:
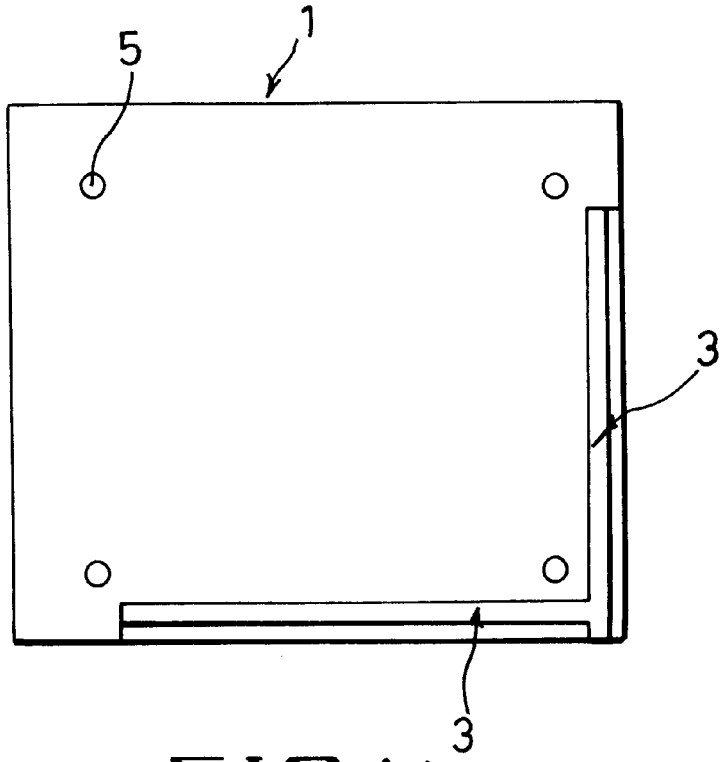
FIG. 4*c* is a top plan view of an edge side plastic panel according to the invention.
Figure 4D:
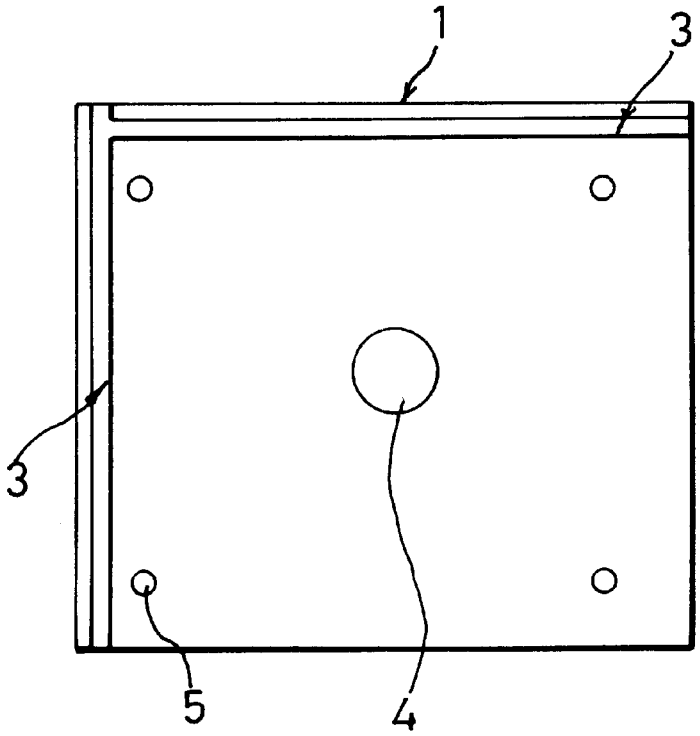
FIG. 4*d* is a top plan view of a plastic panel to install the ventilation plate.
Figure 9:
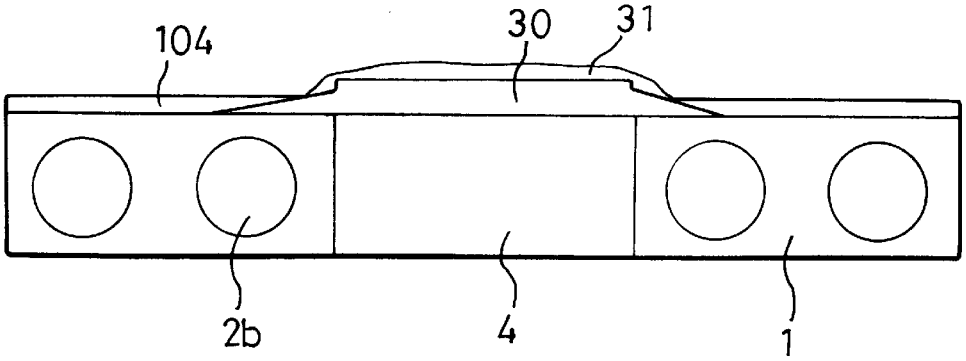
FIG. 9 is a sectional view of plastic panels after installation of the ventilation plate.

Specially designed panels have a hole 4 in the middle of the panel 1, as seen in FIG. 4*d* and FIG. 9, to set a ready-made ventilation plate 30 and 31, as seen in FIG. 9, for ventilation of vapor existing between the waterproofing layer 1 and the concrete substrate 10, as seen in FIG. 2.

Figure 5:
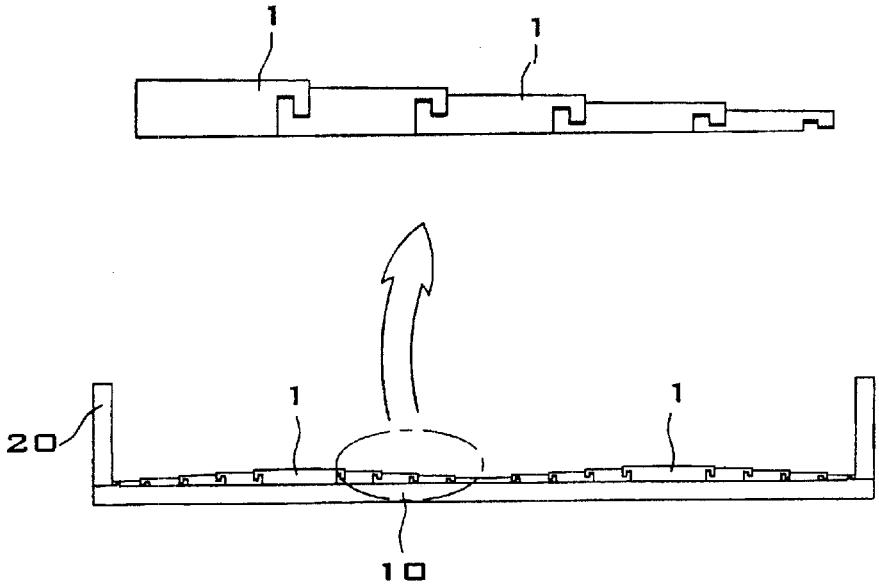
FIG. 5 is a sectional view showing the sloped step shape of the waterproofing layer for drainage of water after installation of plastic panel according to the invention.

The proper slope of waterproofing layer is an important element for fast drainage of stagnant water in the installation of roof waterproofing systems. In the invention, the plastic panel 1 can be manufactured in various sizes. Currently preferred sizes include 1 m×1 m or 1 yd.×1 yd., and range in thickness from 2 to 15 cm. The plastic panels 1 may be connected to each other to form a sloped step, as seen in FIG. 5. This is accomplished by placing progressively thicker panels next to a thin panel. This formation has an advantage of fast drainage against stagnant water on the waterproofing layer 1.

Figure 6:
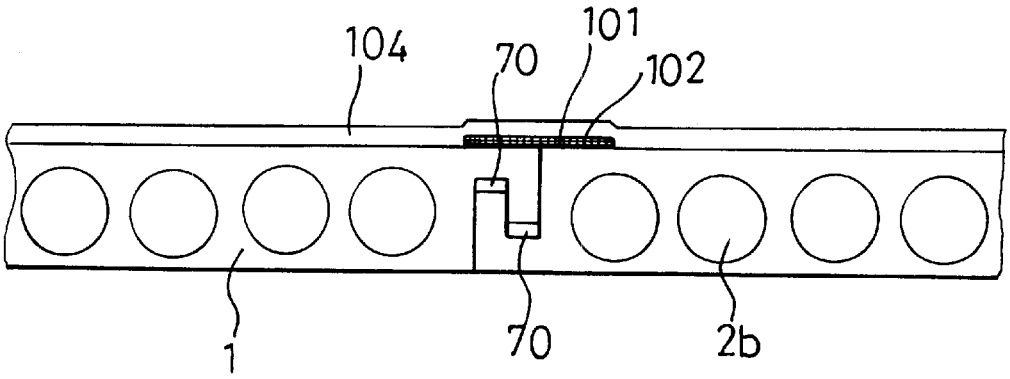
FIG. 6 is a sectional view of the connecting joint part section of the plastic panel-waterproofing layer according to the invention.

One or more plastic panels 1 may be easily joined by the groove and tongue joint 3 without any special machine or tools, as seen in FIGS. 1 and 6. The groove and tongue joint 3 may firmly connect the plastic panels 1 adjacent to each other for installation of the waterproofing layer, as seen in FIGS. 5 and 8, at the job site. Because the connection joint is preferably reinforced by using mesh 102 with fiber and liquid-applied materials 104, as seen in FIG. 6, problems of water leakage, blistering, cracking and tearing can be eliminated.

The connection joint part by the groove and tongue joint 3 is preferably reinforced with the fiber mesh 102 after sealing with sealant 70, as seen in FIG. 6. The fiber mesh 102 is attached after it is applied with a polymeric resin, such as epoxy resin bond 101 on the joint line of panel 1. Fiber mesh 102 is impregnated with a polymeric resin to reinforce the connection joint. These joint parts physically provide rigidity against movement and watertightness in the waterproofing system of the plastic panel 1. In the invention, the fiber mesh 102 may include a variety of possible reinforcing fibers, such as glass fiber, carbon fiber or aramid fiber, for the purpose of reinforcing cracks in concrete structure. In forming the fiber mesh 102, woven fiber is preferable to unwoven fiber.

As seen in FIGS. 2 and 5, when the waterproofing layer 1 is exposed to weather, it can be covered with fluid-applied material 104 or cementitious material 104 to prevent aging of the plastic panel by weather.

Figure 10:
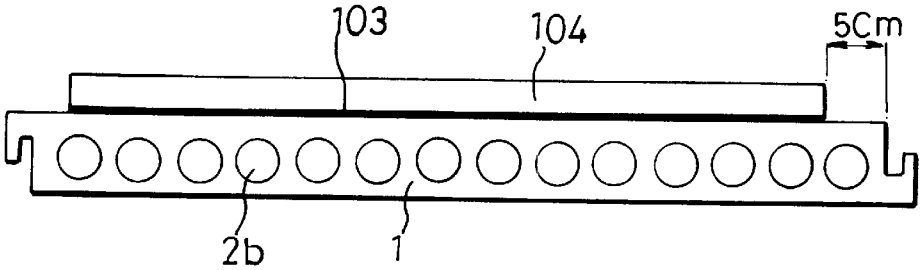
FIG. 10 is a sectional view of a plastic panel having applied thereto, the fluid-applied material and the sheet membrane.

The invention includes the multi-ply plastic panel preliminarily applied with membrane 104 such fluid or sheet materials for protection or reinforcement on the surface of the hollow plastic panel 1, as seen in FIG. 10. These membrane materials should be attached during manufacture, leaving a space of about 5 cm from each edge of the panel 1, as seen in FIG. 10. This space is reinforced by fiber mesh and fluid-applied membrane after each panel 1 is connected by the groove and tongue joint 3, at construction site.

The conventional single-ply waterproofing systems that use only fluid or sheet membrane systems frequently have disadvantages including blisters, debondment, cracks, tears, etc. due to careless construction and poor surface conditions of the concrete substrate. Thus, the invention provides the improved solution method in order to overcome these disadvantages.

The invention protects the waterproofing layer and prevents blisters, cracks and aging by stagnant water, as well as puncture by exterior impact, such as dropping heavy objects or heavy walking on the waterproofing layer.

Molded plastic panels within the scope of the present invention may be prepared in a wide variety of sizes and shapes to suit different roof configurations. The plastic panels may easily be carried and handled thereby simplifying waterproofing construction compared to the conventional fluid-applied membrane or sheet membrane system.

The invention provides a watertight waterproofing layer and provides effective heat insulation by many hollow portions in the panel.

Although many details are shown in the invention, the invention is not limited to the preferred embodiments disclosed herein. For example, the plastic panels can be provided in various sizes and holes. For the purpose of providing a waterproofing layer against extreme weather conditions, multiple layers can be used.

What is claimed is:

1. A waterproofing method by using a plastic panel comprising:

installing onto a flat roof substrate a main waterproofing layer comprising a plurality of hollow plastic panels which have different thicknesses to form a slope when progressively thicker panels are assembled next to a thin panel by groove and tongue joints, and installing a supplementary waterproofing layer comprising sheet membrane materials on roof vertical surfaces, wherein the main waterproofing layer is formed in a sloped step by connecting the groove and tongue joints of adjacent hollow panels which vary in thickness, thereby permitting fast drainage of stagnant water.

2. A waterproofing method as recited in claim 1 wherein said plastic panels are molded in size of about 1 m×1 m and made of polymeric material.

3. A waterproofing-method as recited in claim 2 wherein said plastic panels have designed hollow holes, groove and tongue joints, a ventilation hole, and fixing holes.

4. A waterproofing method as recited in claim 3 wherein said designed hollow holes are in the shape of a quadrangle, circle or rectangle.

5. A waterproofing method as recited in claim 3 wherein said thickness of the panels is in the range in thickness from about 2 to 15 cm.

6. A waterproofing method as recited in claim 3 wherein said groove and tongue joints are formed on the upper and lower surfaces of the hollow panels, and made freely in size (web and depth of the groove or height and web of the tongue) to connect each panel.

7. A water proofing method as recited in claim 3 wherein said ventilation hole is made in the middle of said plastic panel and is configured to be covered with a ready-made ventilation plate for ventilating vapor existing between said main waterproofing layer and the roof substrate.

8. A waterproofing method as recited in claim 3 wherein said fixing holes are made in corners of the hollow plastic panel.

9. A waterproofing method as recited in claim 1 wherein the connection line of the groove and tongue joint of each panel is reinforced with fiber mesh, the fiber mesh being one of glass fiber, carbon fiber, or aramid fiber and attached by epoxy resin bond on the connection line.

10. A molded flat plastic panel useful in waterproofing a flat roof substrate comprising:

a plurality of hollow channels disposed in the flat plastic panel, said channels having a quadrangle, square, circle or other geometric cross-sectional configuration;

a groove and tongue joint manufactured on upper and lower surfaces of one or more panel edges to permit horizontal joining of adjacent panels;

a plurality of fixing holes for securing the flat plastic panel to the roof substrate; and wherein said plastic panel is molded in a size of about 1 m×1 m, and wherein said plastic panel has a thickness ranging from about 2 to 15 cm.

* * * * *